US007426766B2

(12) United States Patent
Gammons

(10) Patent No.: US 7,426,766 B2
(45) Date of Patent: Sep. 23, 2008

(54) TUFTED AIR MATTRESS AND METHOD OF MAKING SAME

(75) Inventor: Clifford E. Gammons, Loudon, TN (US)

(73) Assignee: Adroit Development, Inc., Loudon, TN (US)

( * ) Notice: Subject to any disclaimer, the term of this patent is extended or adjusted under 35 U.S.C. 154(b) by 0 days.

(21) Appl. No.: 11/566,226

(22) Filed: Dec. 3, 2006

(65) Prior Publication Data

US 2008/0127423 A1 Jun. 5, 2008

(51) Int. Cl.
*A47C 27/10* (2006.01)
*A47C 27/08* (2006.01)
*B32B 37/26* (2006.01)

(52) U.S. Cl. ..... 5/713; 5/710; 5/706; 5/932; 156/289

(58) Field of Classification Search ..... 5/713, 5/706, 710, 712, 644, 654, 655.3, 932; 156/289, 156/292, 308.4, 309.6
See application file for complete search history.

(56) References Cited

U.S. PATENT DOCUMENTS 1,625,810 A * 4/1927 Kirchbaum ..... 156/192
1,777,982 A 10/1930 Popp
2,318,492 A * 5/1943 Johnson ..... 5/712
2,703,770 A * 3/1955 Melzer ..... 5/710
3,030,640 A * 4/1962 Gosman ..... 441/40
3,653,083 A 4/1972 Lapidus
3,868,056 A * 2/1975 Keren ..... 206/521
4,149,541 A 4/1979 Gammons et al.
4,314,865 A * 2/1982 Ottaviano ..... 156/145
4,347,633 A 9/1982 Gammons et al.
D266,470 S 10/1982 Gammons et al.
D270,983 S 10/1983 Gammons et al.
4,415,398 A * 11/1983 Ottaviano ..... 156/470
4,472,847 A 9/1984 Gammons et al.
4,483,030 A * 11/1984 Flick et al. ..... 5/691
5,022,109 A 6/1991 Pekar
5,044,030 A * 9/1991 Balaton ..... 5/710
D325,841 S 5/1992 Gammons
5,638,565 A * 6/1997 Pekar ..... 5/710
5,647,078 A 7/1997 Pekar
6,102,936 A 8/2000 Augustine et al.
6,209,286 B1 * 4/2001 Perkins et al. ..... 53/403
6,546,580 B2 * 4/2003 Shimada ..... 5/710
2002/0050010 A1 * 5/2002 Shimada ..... 5/706
2004/0098807 A1 * 5/2004 Ham ..... 5/655.3

* cited by examiner

*Primary Examiner*—Robert G Santos
(74) *Attorney, Agent, or Firm*—Knox Patents; Thomas A. Kulaga

(57) ABSTRACT

A tufted air mattress including a first printed sheet and a second sheet. The first printed sheet is printed over a selected area with an ink containing a fluoropolymer. The portion of the printed sheet with the ink defines a coated area. The first printed sheet attached to the second sheet where the printed sheet is not coated with the ink. The coated area of the printed sheet inhibits heat welding of the first sheet to the second sheet. The coated area also lubricates the first and second sheets to aid in inflating the air mattress without flaking and contaminating the air inflating the air mattress. In one embodiment of such a mattress, three sheets define two air volumes that are alternatingly inflated and deflated through an alternating air supply valve.

6 Claims, 5 Drawing Sheets

TUFTED AIR MATTRESS AND METHOD OF MAKING SAME

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to a tufted air mattress formed of three congruent thermoplastic sheets with two of the sheets printed with a fluoropolymer containing ink before being heat sealed. More particularly, this invention pertains to a therapy system including the tufted air mattress, which includes two chambers for containing air, that is inflated from an air supply passing through an alternating air supply valve, which inflates each chamber individually and sequentially in an alternating manner, while deflating the other chamber.

2. Description of the Related Art

Inflatable thermal mattresses are often used in medical environments to support patients and to provide thermal conditioning to patients. For patients who are bedridden or who are immobilized for long periods of time, the prevention of skin rashes and bed sores caused by pressure applied by the mattress to the patient is a concern.

Many diverse air mattresses are known in the art. For example, U.S. Pat. No. 4,347,633, titled "Patient treating mattress," issued to Gammons, et al., on Sep. 7, 1982, and U.S. Pat. No. 4,472,847, with the same title and issued to Gammons, et al., on Sep. 25, 1984, disclose crawl resistant flexible mattresses formed of panels sealed together. Both patents disclose mattresses with inflatable passages and a top surface with vent holes for exhausting conditioned air to ventilate the patient. The mattresses are formed of panels sealed together, and either one or both of the panels can be preformed by vacuum or pressure molding. The patents disclose heat sealing the top and bottom panels through a fusion process, but does not provide additional details on the fusion process.

U.S. Pat. No. 4,149,541, titled "Fluid circulating pad," issued to Gammons, et al., on Apr. 17, 1979, discloses a flexible pad with interconnecting waffle-grid patterned passages. The pad is formed of a pair of flexible thermoplastic panels sealed together about a peripheral seal. The patent does not provide any details regarding how the seals are formed.

U.S. Pat. No. 6,102,936, titled Inflatable thermal pad with drainage," issued to Augustine, et al., on Aug. 15, 2000, discloses an inflatable convective thermal pad for use under a patient. The pad is formed of two layers joined and sealed at their periphery and at various other points. The patent discloses ultrasonic welding as one technique that may be used to form a seal between the layers. The patent also discloses alternative techniques of RF sealing or heat sealing, without providing any details as to how these techniques are applied to form the thermal pad.

U.S. Pat. No. 3,653,083, titled "Bed pad," issued to Lapidus on Apr. 4, 1972, discloses an aerated bed pad that has a variable flexing motion. In one embodiment, the pad includes a tubular member that alternately inflates and deflates, and the tubular member is interlaced with resilient strips that provide a floor on deflation. In another embodiment, the pad includes two interlaced tubular members that are alternately inflated and deflated. The pad if formed of two sheets of relatively think plastic, such as vinyl plastic, that are vacuum formed and heat sealed. Although the patent discloses heat sealing as the technique for forming a seal between the two sheets, it does not provide any details as to how heat sealing is applied to the sheets to form the pad.

Various techniques of forming inflatable mattresses and pads are used. One such technique is to glue or apply an adhesive or solvent between the two sheets of material forming the mattress. Another technique is to ultrasonically weld the two materials to form a seal.

Still another technique is to heat seal. Heat sealing involves applying heat to the area where the seal is desired. One method of applying heat to selected areas is by using a heated die with a raised pattern corresponding to the areas to be sealed. For mattresses, which are large, this method is cumbersome because it requires a heated die the size of the mattress. A similar method is by ultrasonic welding of selected areas.

Another method is to place a third sheet of incompatible material between the two sheets before applying heat to the three sheets. The third sheet is sized and has openings arranged so as to allow the two thermoplastic sheets to fuse while preventing the two sheets fusing where the third sheet is interposed. While this method allows the use of heated roller to heat seal, it also requires the use and handling of a third sheet, which increases the production costs.

U.S. Pat. No. 5,022,109. titled "Inflatable bladder," issued to Pekar on Jun. 11, 1991, discloses a variation on ultrasonic welding in which three layers of sheets form the mattress, but only two sheets are welded together at any one spot. Heat energy, such as by ultrasonic welding, is applied to the sheets in specific areas in order to form seals. Barrier coatings, or coated bands, are applied in alternating strips on both sides of the middle sheet. The barrier coatings allow one outside sheet and the middle sheet to be sealed on one side of the middle sheet and the coating prevents the other outside sheet from sealing to the middle sheet at the same location. The barrier coatings act as a prophylactic by preventing the heat energy applied to specific areas of the sheets from welding, or fusing, two of the sheets together.

It is an objective of the present invention to provide an economical way of fabricating a tufted air mattress by heat sealing with heat applied to the full surface of the mattress, as opposed to localized, or spot, welding.

It is another objective of the present invention to provide areas on a thermoplastic sheet defining a connection between adjacent sheets when heat is applied to the full area of the mattress or bladder.

It is still another objective of the present invention to provide two isolated chambers that are inflated and deflated in an alternating manner.

BRIEF SUMMARY OF THE INVENTION

According to one embodiment of the present invention, a tufted air mattress is provided. The air mattress includes at least two sheets joined together in selected areas, which form a connection between the adjacent sheets. The sheets of the air mattress are a thermoplastic material. An outer sheet is printed with a special ink that inhibits heat welding of the printed sheet with an adjacent sheet. The ink is applied with a specified pattern consisting of inked, or coated, areas and un-inked, or uncoated areas. The uncoated areas define a connection between adjacent sheets. In one embodiment the ink includes a fluoropolymer, for example, Teflon. The ink adheres to the thermoplastic sheet, and the fluoropolymer inhibits forming a welded connection when it is positioned between two sheets of thermoplastic material that are heated.

The printed sheet and a second sheet are heat sealed such that the uncoated areas of the printed sheet are heat welded to the second sheet and the coated areas are not heat welded to the second sheet. When the air mattress is inflated, the sheets of the air mattress adjacent the coated areas are pushed apart by the air pressure inflating the air mattress, thereby forming a volume inside the air mattress bounded by the two sheets and the connection of the two sheets joined together at an uncoated peripheral area. The coated areas also act as a lubricant to aid in the separation of the two sheets when the air mattress is inflated.

In one such embodiment, the printed sheet is printed with an uncoated area around the periphery of the sheet and with a plurality of small rounded uncoated areas. With the two sheets heat sealed to form an air mattress, the air mattress inflates to form a tufted mattress with tucks where the small rounded uncoated areas join the two sheets and the area surrounding the uncoated areas pillow-shaped.

One embodiment of such an air mattress includes three sandwiched sheets with the two outside sheets having their inside surfaces printed with the ink. The small rounded uncoated areas on the two outside sheets are positioned with an alternating pattern such that when the air mattress is inflated, the mattress exerts a relatively constant pressure against an object resting on the mattress. This embodiment of the air mattress has two separate air chambers defined by the mattress: an upper chamber and a lower chamber. An air supply provides pressurized air to each chamber in an alternating manner. That is, the upper chamber of the air mattress is inflated for a period of time and then the air supply is diverted to the lower chamber of the air mattress, which is inflated for another period of time. The chamber that is not being inflated currently is having its air exhausted at a slow rate. This cycle repeats continuously, thereby reducing the likelihood of a user of the air mattress from getting bedsores and encouraging blood circulation of the user.

An alternating air supply valve that repetitively switches the air supply to the two chambers is disclosed. In one embodiment, the alternating air supply valve includes two solenoid operated three-way air valves operated by a controller that selectively actuates each solenoid operated valve. Another embodiment of the alternating air supply valve includes a rotating member with a central orifice and another orifice on the rotating surface that periodically aligns with each of a pair of ports when the rotating member rotates within a housing. Yet another embodiment includes a disk-shaped rotating member with a through-opening that rotates past each of a pair of ports, thereby allowing air to flow through each of the ports in an alternating manner.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
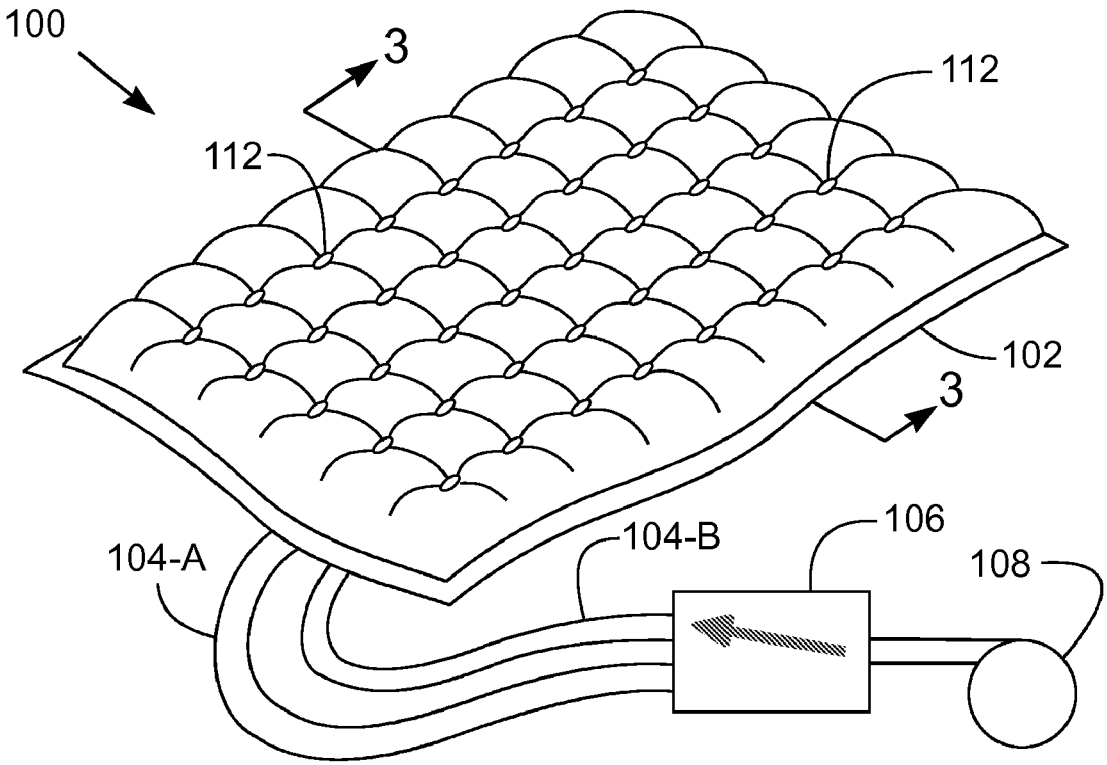
FIG. 1 is a perspective view of an air mattress with an alternating air supply valve.

A tufted air mattress, generally shown as 102 in the figures, is disclosed. FIG. 1 illustrates a perspective view of an air mattress system 100 that includes an air mattress 102 with an alternating air supply valve 106. The illustrated air mattress 102 is shown as a rectangular pad with multiple tufts 112 over its surface. In other embodiments, the mattress 102 has a shape that meets the requirements of its applications, such as a round or oval shape.

Two air supply hoses 104-A, 104-B connect the air mattress 102 to an alternating air supply valve assembly 106, which is, in turn, connected to a pump 108, which supplies air. The air supply hoses 104 each connect to one of a pair of separate air volumes 306-A, 306-B in the mattress 102 through corresponding inlet ports. The alternating air supply valve 106 receives a supply of input air and switches that supply of input air to each of the hoses 104-A, 104-B one at a time and sequentially. That is, the valve 106 allows air to flow through one hose 104-A to inflate one volume in the mattress 102 for a period of time, then the valve 106 switches the air flow to the other hose 104-B to inflate the other volume in the mattress 102 for a period. The valve 106 switches the air flow continuously. In some cases, it has been found to be beneficial to patients to alternate the inflation of the two volumes approximately every twenty seconds.

In another embodiment, the two volumes in the mattress are not isolated but are connected such that the air flowing from one hose 104-A enters the mattress 102 and flows through first one volume and then through the other volume before exiting through the other hose 104-B. In such an embodiment, the switching valve 106 is not used and the two hoses 104 are connected to a recirculation pump 108.

Figure 2:
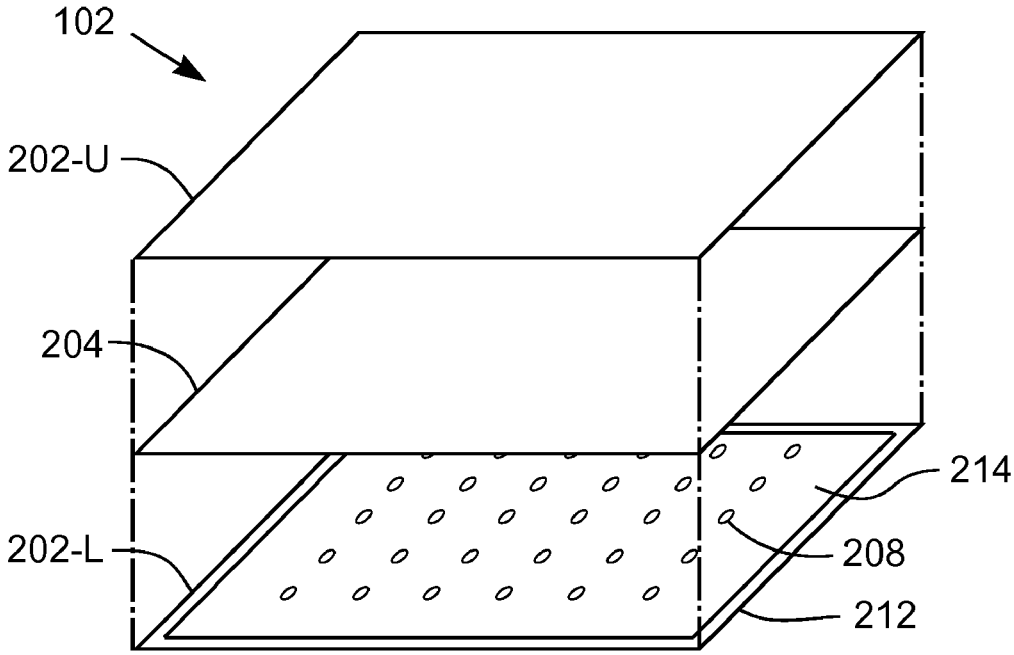
FIG. 2 is an exploded view of one embodiment of the air mattress.

FIG. 2 illustrates an exploded view of one embodiment of the air mattress 102. The mattress 102 includes three sheets 202-U, 204, 202-L. The three sheets 202, 204 are a thermoplastic material that is suitable for connecting together as by heat sealing. In one embodiment, the material of the sheets 202, 204 is impermeable to gas, thereby allowing the mattress 102 to inflate. In another embodiment, the material of the sheets 202 is permeable to gas, thereby allowing the mattress 102 to inflate, but with the air exhausting through one or both of the sheets 202.

In the illustrated embodiment, the upper sheet 202-U is a mirror image of the lower sheet 202-L. The two sheets 202 include a coated area 214 that defines an uncoated periphery 212 and multiple uncoated spots 208 within the uncoated periphery 212. The sheets 202-U, 202-L are printed with an ink to create the coated area 214. The printed pattern is such that the uncoated periphery 212 and the multiple uncoated spots 208 have no ink on the inside surface of the sheet 202. In one embodiment, the uncoated spots 208 on the outer sheets 202 are arranged in a cross-hatched pattern. A cross-hatched pattern is one where the uncoated spots 208 are positioned at the intersections of a group of parallel lines crossing a perpendicular group of parallel lines. In such an embodiment, although the spots 208 are arranged in a cross-hatched pattern, the spots 208 are not line segments.

The ink has the characteristic of inhibiting welding of the sheets 202 to the center sheet 204 when the sheets 202, 204 are heat sealed. When heat is applied to the full surface, such as by a heated roller, the three sheets 202, 204 are joined (connected) at the areas 212, 208 where there is no ink, thereby forming the mattress 102 as illustrated in FIG. 1. Where the ink coats the sheet 202, that is, at the coated area 214, the sheets 202, 204 do not fuse together when heat sealed. In one embodiment, the ink has the characteristic of being a lubricant that is firmly adhered to the surface of the sheet 202 such that the ink does not separate from the sheet 202 during use. Before the mattress 102 is inflated, the sheets 202, 204 are in close proximity, and most likely in contact with each other over their full surface. When air is introduced into the mattress 102 and the sheets 202, 204 begin to separate, the ink at the coated area 214 is a lubricant that prevents the sheets 202, 204 from sticking together and the ink allows the sheets 202, 204 to easily separate. Further, because the ink is the lubricant and the ink adheres to the sheets 202 in the coated areas 214, the ink will not separate from the sheets 202 and contaminate the air used to inflate the mattress 102. Contamination of the air exhausted from the mattress 102 is to be avoided because contaminated air may be harmful to individuals exposed to that air and/or to equipment that processes the air, if that air is recirculated.

In one embodiment, the ink includes a fluoropolymer, for example, Teflon. The fluoropolymer gives the ink the characteristics of inhibiting heat sealing and lubrication in the coated areas 214. In various tests, inks containing silicon were found to be undesirable because the silicon containing ink was determined to bleed and spread when applied to coated areas 214 defining small uncoated areas 208. Therefore, the silicon containing ink was found to have an undesirable affect on the areas 212, 208 desired to be uncoated. Fluoropolymer containing inks minimize the bleeding and spreading of the ink during printing of the ink on the sheet 202. The sheets 202 are printed with the ink to form the coated areas 214, in one embodiment, by a flexographic printing process in which the sheets 202 are printed as a web. In other embodiments, the sheets 202 are screen printed to form the coated areas 214.

In the illustrated embodiment, the center sheet 204 does not have any ink printed on it such as to form a coated area 214. In one embodiment, the air supply hoses 104 are attached to the mattress 102 by placing the end of one hose 104-A between the upper sheet 202-U and the center sheet 204 such that the very end of the hose 104-A falls within the coated area 214. The other hose 104-B is similarly placed between the lower sheet 202-L and the center sheet 204. When the sheets 202, 204 are heat sealed, the uncoated periphery 212 fuses to the hose 104 where the hose 104 contacts the sheets 202, 204, thereby forming a seal around the hoses 104.

The mattress 102 formed by the sheets 202, 204 is heat sealed by applying heat to the sheets 202, 204 when the sheets 202, 204 are aligned and in physical contact with each other. In one embodiment, the mattress 102 is heat sealed by applying a flat heated surface to the sheets 202, 204, which are supported on a flat surface. In another embodiment, the mattress 103 is heat sealed by a heated roller contacting the sheets 202, 204. Accordingly, one method of manufacturing the tufted air mattress 102 is to coat one surface of the upper sheet 202-U, coat one surface of the lower sheet 202-L, position a center sheet 204 between the coated areas 212 of the upper and lower sheets 202, and apply heat across the full width and full length of the mattress 102, such as with a heated roller. The uncoated areas 208, 212 will be heat fused and the coated areas 214 will inhibit heat fusing in those areas. In various embodiments, such a method includes installing ports to the two chambers 306-A, 306-B, attaching an air supply including a pump 108 and an alternating valve assembly 106.

Figure 3:
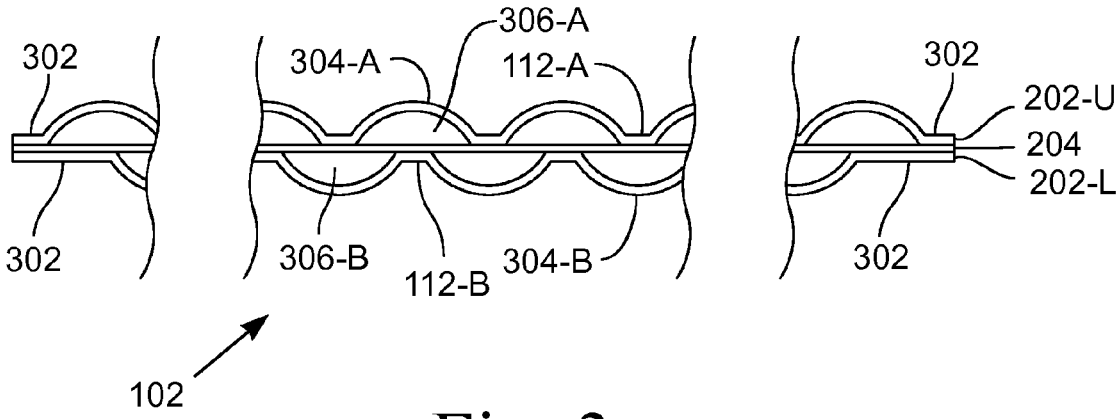
FIG. 3 is a cross-sectional view of one embodiment of the air mattress.

FIG. 3 illustrates a cross-sectional view of one embodiment of the air mattress 102 showing a cross-section cutting through the upper and lower tufts 112-A, 112-B. The three sheets 202-U, 204, 202-L are connected together at a peripheral seam 302 that is adjacent the uncoated periphery 212 on the outer sheets 202. Also, each outer sheet 202 is connected to the center sheet 204 at the uncoated spots 208 to form the tufts 112-A, 112-B. Adjacent the tufts 112, the upper sheet 202-U and the lower sheet 202-L separate from the center sheet 204 to form pillow-shaped portions 304-A, 304-B that define a first and second volume 306-A, 306-B, respectively. It is to be remembered that, in the cross-sectional view of FIG. 3, the tufts 112 are small spots and the pillow-shaped regions 304 extend completely around each tuft 112.

Figure 4:
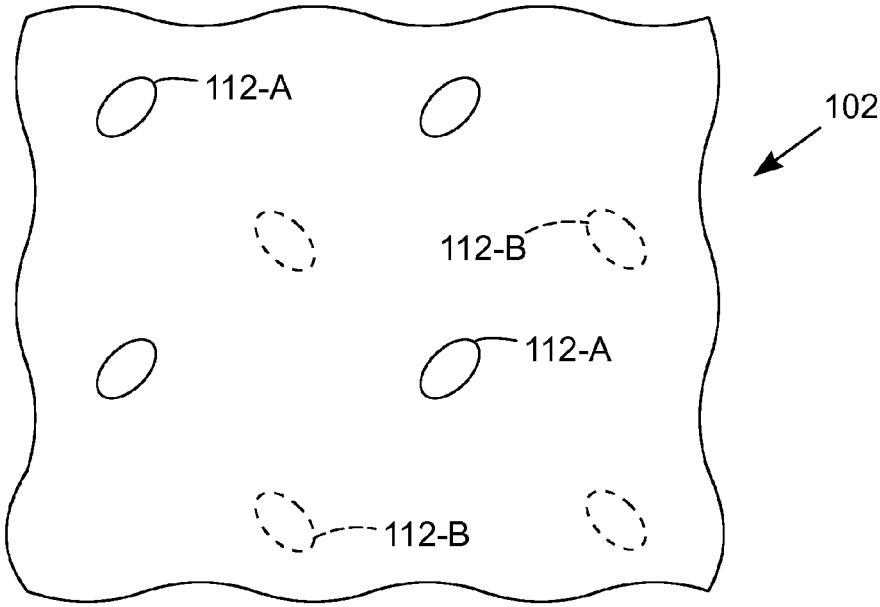
FIG. 4 is a partial plan view of the tufted air mattress showing the position of the upper and lower tufts.

FIG. 4 illustrates a partial plan view of the air mattress 100 showing the position of the upper and lower tufts 112-A, 112-B. In the illustrated embodiment, the tufts 112 have an oval shape that corresponds to the shape of the uncoated spots 208 defined by the ink on the sheets 202. An oval shape is one having a perimeter that is circular or ovoid. The rounded shape ensures that the stress at the interface between the coated area 214 and the uncoated spots 208 is distributed around the periphery of the uncoated spots 208 and that there are no points or corners that would result in higher stress when the mattress 102 is inflated, which could tear the sheets 202.

The upper tufts 112-A form a regular pattern that is not aligned with the lower tufts 112-B, which also form a regular pattern. The offset of the tufts 112-A, 112-B is also visible in FIG. 3. The offset tufts 112-A, 112-B result in the upper and lower pillow-shaped portions 304-A, 304-B being offset vertically. In one embodiment, the first and second volumes 306-A, 306-B are independent, separated by the center sheet 204. The volumes 306-A, 306-B are sequentially inflated with a specified period, thereby presenting a slowly pulsing pad to a user. With the tufts 112-A, 112-B offset and with the upper and lower pillow-shaped portions 304-A, 304-B offset vertically, when the upper volume 306-A is inflated, the upper pillow-shaped portions 304-A are inflated, presenting an area of support to a user resting on the mattress 102. When the lower volume 306-B is inflated and the air pressure in the upper volume 306-A is reduced, the lower pillow-shaped portions 304-B are inflated, presenting a different area of support to the user resting on the mattress 102.

Figure 5:
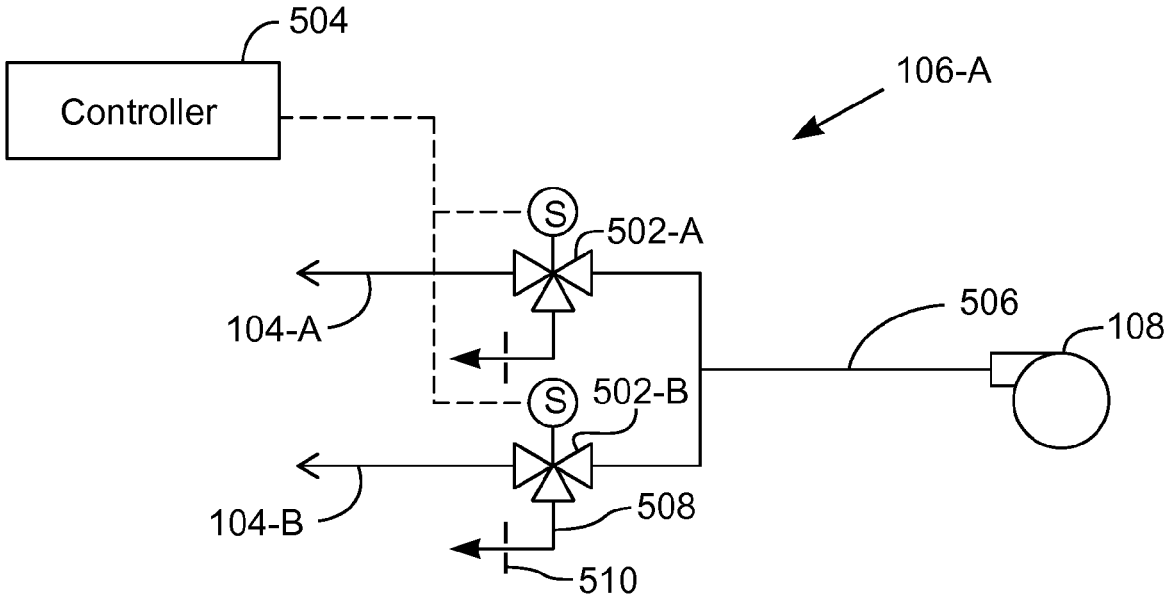
FIG. 5 is a symbolic diagram showing one embodiment of the alternating air supply valve.

FIG. 5 illustrates a symbolic diagram showing one embodiment of the alternating air supply valve 106-A. An air supply 108 is connected, through a supply hose 506 connected to an alternating air supply valve 106-A, which is connected to a pair of air supply hoses 104 each connected to the two volumes 306-A, 306-B of the mattress 102. The alternating air supply valve 106-A includes a pair of solenoid valves 502 that have common inputs receiving air from the air supply 108. Each solenoid valve 502 is a three-port valve with one output connected to one of the air supply hoses 104 connected to the mattress 102 and the other output 508 exhausting to the atmosphere through a restrictor, or orifice, 510 that prevents the air in the volume 306 from exhausting immediately. The solenoid valves 502 are connected to a controller 504 that actuates the valves 502 to alternate the connection of the air supply 108 to one of the hoses 104. For example, one solenoid valve 502-A is actuated when the other solenoid valve 502-B is not actuated, resulting in air flowing into the air supply hose 104-A and inflating the volume 306-A of the mattress. After a specified time, the controller 504 causes the first solenoid valve 502-A to not be actuated and actuates the second solenoid valve 502-B, thereby resulting in air flowing into the air supply hose 104-B and inflating the other volume 306-B of the mattress. In the illustrated embodiment, the solenoid valves 502 are two-position three-port valves and the solenoid valve 502 that is not actuated is discharging the air from the supply hose 104 connected to the output of that solenoid valve 502. Three-port valves are valves in which one port is switched to, or connected with, one of two other ports. In such an embodiment the air pressure in one of the volumes 306 is being relieved while the air pressure in the other one of the volumes 306 is being maintained. This embodiment is suited for a mattress 102 that is air tight and does not exhaust air away from the surface of the mattress 102.

In another embodiment, the valves 502 are not three-port valves, but only control the flow of air to the mattress 102. In such an embodiment, the air exhausts from the mattress 102 in some manner other than through the supply hoses 104. One such embodiment includes perforations, openings, or a sheet 202-U that is permeable to air, thereby providing air to the immediate environment of the mattress 102.

Figure 6:
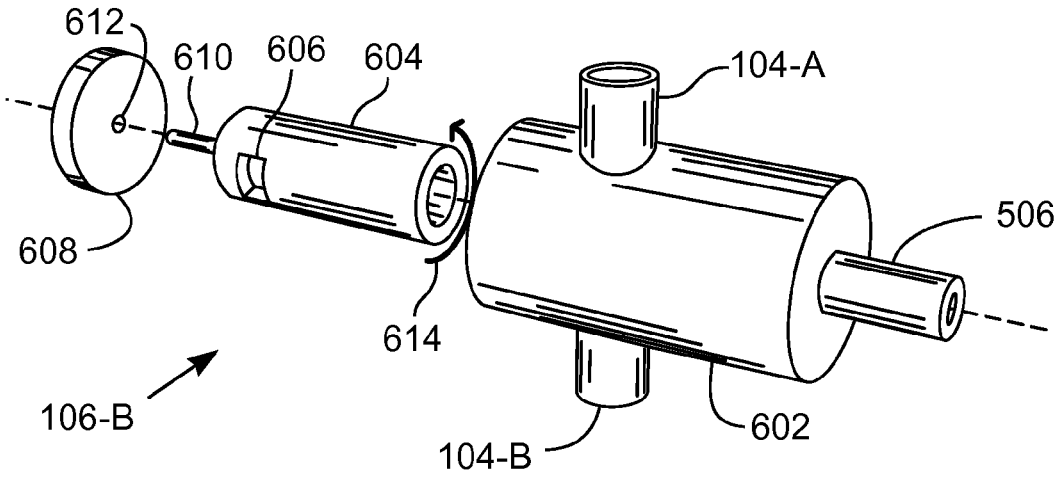
FIG. 6 is an exploded perspective view of another embodiment of the alternating air supply valve.

FIG. 6 illustrates an exploded perspective view of another embodiment of the alternating air supply valve 106-B. The embodiment of the alternating air supply valve 106-B illustrated in FIG. 6 includes a valve body 602, a rotating orifice 604, and a plug 608. The valve body 602 is a hollow cylinder with one end closed with an inlet port 506 aligned with the longitudinal axis of the body 602. On opposite sides of the cylindrical portion of the valve body 602 are ports for the air supply hoses 104-A, 104-B.

The rotating orifice 604 has a cylindrical body that fits inside the hollow portion of the cylindrical valve body 602. The end of the rotating orifice 604 opposite the inlet port 506 is closed with a shaft 610 protruding along the longitudinal axis of the rotating orifice 604. On the cylindrical portion of the rotating orifice 604 is an orifice 606 that connects the hollow inside volume of the rotating orifice 604 with the outside of the rotating orifice 604 at a position that aligns with the outlet ports 104-A, 104-B on the valve body 602 when the rotating orifice 604 is fully engaged in the valve body 602. In one embodiment, the orifice 606 extends no more than 180 degrees or half-way round the circumference of the rotating orifice 606 so as to form a fluid path between the inlet port 506 and only one of the outlet ports 104.

The plug 608 fits into the end of the hollow valve body 602 and seals the rotating orifice 604 inside the valve body 602. The plug 608 includes a through-opening 612 that allows the shaft 610 of the rotating orifice 604 to pass through. With the alternating air supply valve 106-B assembled, the shaft 610 protrudes past the outside surface of the plug 608 and is connected to a rotary drive motor that rotates 614 the rotating orifice 604 relative to the valve body 602. The rotation 614 of the rotating orifice 604 alternatingly creates a flow path between the inlet port 506 and one or the other of the outlet ports 104. With the rotating orifice 604 rotating 614 at a specified speed, the period of air flow through each outlet port 104 is controlled.

In one embodiment, two alternating air supply valves 106-B have the air supply hoses 104-A, 104-B connected in parallel and having the port 506 of one valve 106-B connected to the pump 108 and the port 506 of the other valve 106-B exhausting to the atmosphere whereby one chamber 306-A, 306-A is inflated by one valve 106-B and the other chamber 306-B, 306-A is deflated by the other valve 106-B, sequentially. In one such embodiment, the exhaust port 506 discharges through a restrictor or orifice 510. The shafts 610 of the two valves 106-B rotate in tandem such that the orifice 606 in one valve 106-B is aligned with one hose 104-A, 104-B when the orifice 606 in the other valve 106-B is aligned with the other hose 104-B, 104-A.

Figure 7:
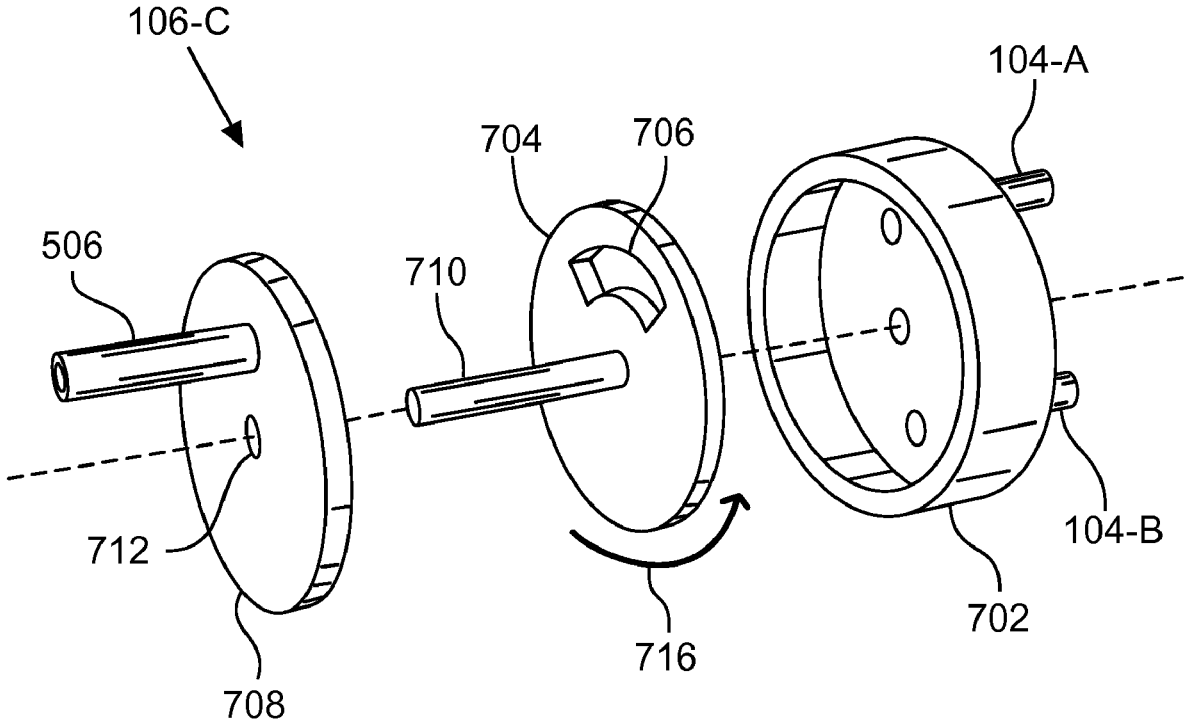
FIG. 7 is an exploded perspective view of still another embodiment of the alternating air supply valve.

FIG. 7 illustrates an exploded perspective view of still another embodiment of the alternating air supply valve 106-C. The embodiment of the alternating air supply valve 106-C illustrated in FIG. 7 includes a valve body 702, a rotating orifice plate 704, and an end plate 708.

The valve body 702 is a short hollow cylinder with two outlet ports 104-A, 104-B located on the closed end of the valve body 702 away from the longitudinal axis of the valve body 702.

The rotating orifice plate 704 is a disk with a shaft 710 perpendicular to and in the center of the plate 704. The rotating orifice plate 704 has an orifice 706 positioned radially away from the center of the plate 704 such that the orifice 706 is positioned adjacent each one of the outlet ports 104-A, 104-B sequentially as the rotating orifice plate 704 rotates 716 inside the valve body 702. The orifice 706 subtends an arc no more than 180 degrees or half-way around the plate 704.

The end plate 708 seals the hollow cavity in the valve body 702 and creates a plenum between the inside surface of the end plate 708 and the rotating orifice plate 704. The end plate 708 includes an inlet port 506 that supplies air to the plenum. The end plate 708 also includes a through-opening 712 that allows the shaft 710 of the rotating orifice plate 704 to pass through.

With the alternating air supply valve 106-C assembled, the shaft 710 protrudes past the outside surface of the end plate 708 and is connected to a rotary drive motor that rotates 716 the rotating orifice plate 704 relative to the valve body 702. The rotation 716 of the rotating orifice plate 704 alternatingly creates a flow path between the inlet port 506 and one or the other of the outlet ports 104. With the rotating orifice plate 704 rotating 716 at a specified speed, the period of air flow through each outlet port 104 is controlled.

In one embodiment, two alternating air supply valves 106-C have the air supply hoses 104-A, 104-B connected in parallel and having the port 506 of one valve 106-C connected to the pump 108 and the port 506 of the other valve 106-C exhausting to the atmosphere whereby one chamber 306-A, 306-A is inflated by one valve 106-C and the other chamber 306-B, 306-A is deflated by the other valve 106-C, sequentially. In one such embodiment, the exhaust port 506 discharges through a restrictor or orifice 510. The shafts 710 of the two valves 106-C rotate in tandem such that the orifice 706 in one valve 106-B is aligned with one hose 104-A, 104-B when the orifice 706 in the other valve 106-B is aligned with the other hose 104-B, 104-A.

Figure 8:
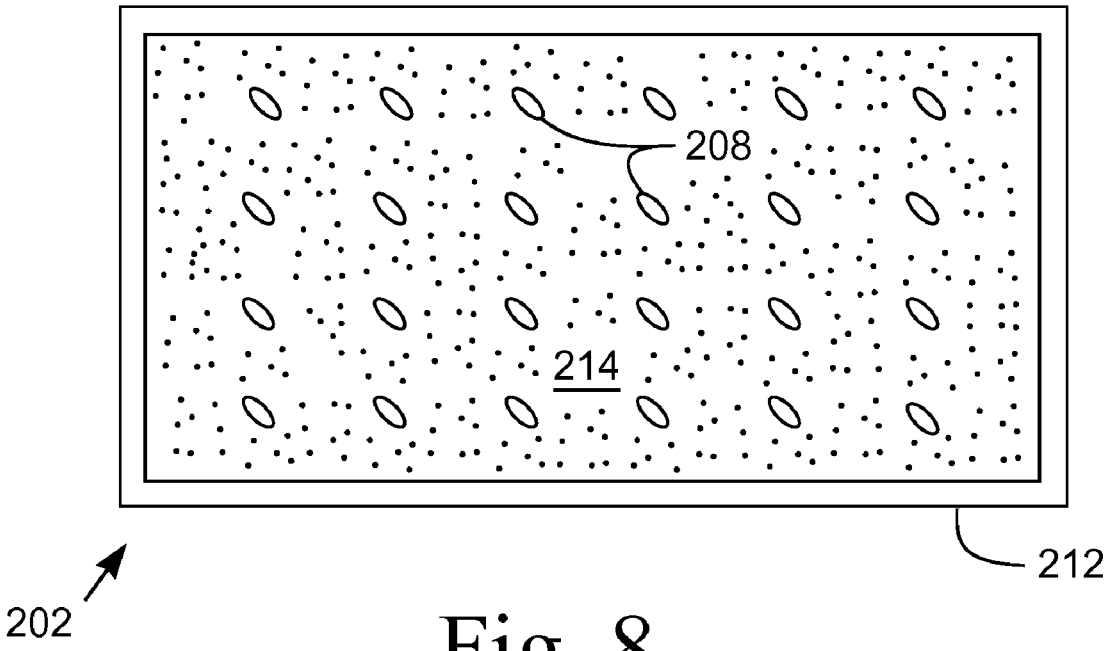
FIG. 8 is a plan view of one embodiment of a printed sheet.

FIG. 8 illustrates a plan view of one embodiment of a printed sheet 202. The printed sheet 202 is for the embodiment as illustrated in FIG. 2. The sheet 202 has a coated area 214 (shown with stippling) that defines an uncoated perimeter strip 212 and that defines an array of uncoated spots 208. The uncoated periphery 212, when heat sealed with another sheet 204, forms a seal around the edge of the mattress 102. The uncoated spots 208, when heat sealed with another sheet 204, form the tufts 112 visible on the surface of the mattress 102.

Figure 9:
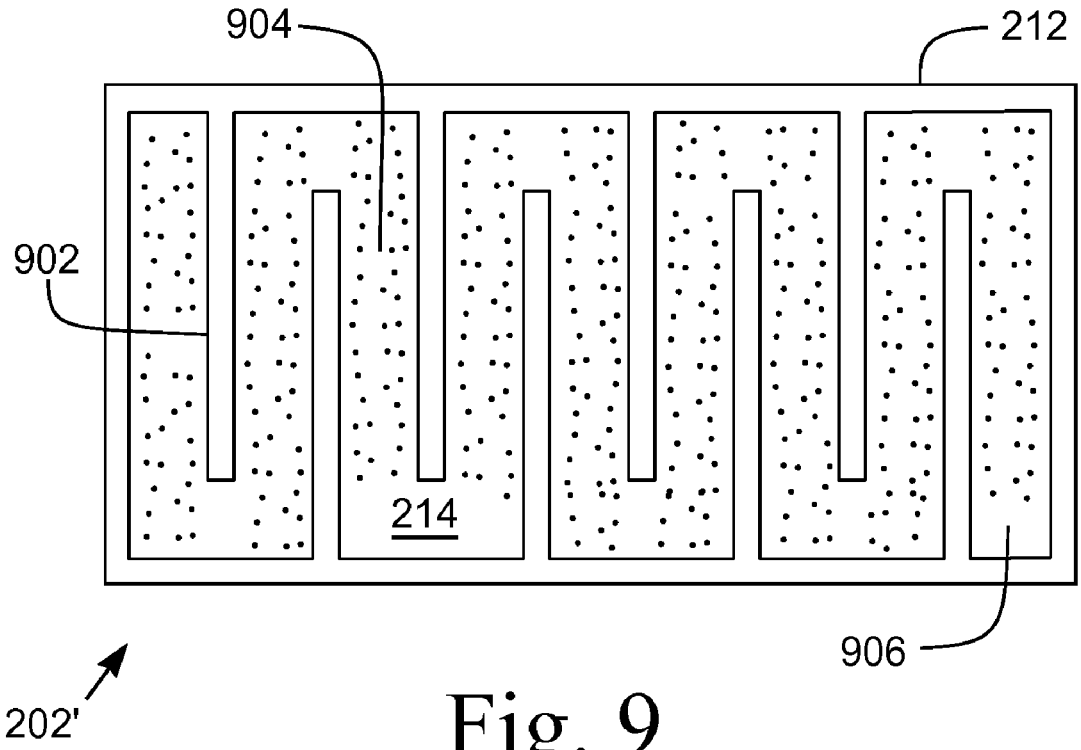
FIG. 9 is a plan view of another embodiment of a printed sheet.

FIG. 9 illustrates a plan view of another embodiment of a printed sheet 202'. In this embodiment, the sheet 202' has an uncoated area 214' that leaves a perimeter strip 212 uncoated and leaves a multitude of strips 902 uncoated. The uncoated strips 902, when heat sealed with another sheet 204, forms a connection between the sheets 202', 204 at the uncoated strips 902. When inflated, the uncoated strips 902 define one wall of a channel 904 having an opposite wall defined by another uncoated strip 902 or the uncoated periphery 212. Air is introduced into the mattress 102 at an inlet area 906 located in one corner of the sheet 202'. In one embodiment, an inlet port in the sheet 202' is a circular opening with a reinforced edge. The inlet port receives a hose 104 from an air supply. The air introduced at the inlet area 906 flows through the channels 904 and inflates the mattress 102. In various embodiments, the uncoated strips 902 are oriented in a transverse direction and/or have varying lengths and configurations.

The air mattress system 100 includes various functions. The function of tufting the air mattress 102, 102' is implemented, in one embodiment, by the uncoated areas 208 heat sealed to the center sheet 204 as illustrated in FIGS. 2, 3, and 9.

The function of alternating the air flow to the chambers 306-A, 306-B is implemented, in one embodiment, by the alternating air supply valve 106-A illustrated in FIG. 5. In another embodiment, the function of alternating the air flow to the chambers 306-A, 306-B is implemented by the alternating air supply valve 106-B illustrated in FIG. 6. In still another embodiment, the function of alternating the air flow to the chambers 306-A, 306-B is implemented by the alternating air supply valve 106-C illustrated in FIG. 7.

From the foregoing description, it will be recognized by those skilled in the art that an air mattress system 100 has been provided. The system 100 includes a tufted air mattress 102 formed of at least two sheets 202, 204 with at least one sheet 202 having a coated surface 214 with uncoated areas 212, 208. The at least two sheets 202, 204 are heat sealed together at the uncoated areas 212, 208, which are small spots that are surrounded by the coated surface 214, which is a layer of ink containing a fluoropolymer.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A method of manufacturing an apparatus for a tufted air mattress, said method comprising the steps of:

coating one surface of a first sheet with an ink to form a first coated region, said first coated region defining a first sheet peripheral edge and a plurality of first uncoated spots arranged in a first pattern, said plurality of first uncoated spots having an ovoid shape, said first sheet being an air-impermeable thermoplastic material and said first coated region including a fluoropolymer;

coating one surface of a second sheet with said ink to form a second coated region, said second coated region defining a second sheet peripheral edge and a plurality of second uncoated spots arranged in a second pattern, said plurality of second uncoated spots having said ovoid shape, said second sheet being an air-impermeable thermoplastic material and said second coated region including a fluoropolymer;

positioning a center sheet between said first and second sheets with said center sheet adjacent said first coated region and said second coated region, said first pattern offset from said second pattern; and applying heat across substantially a full width and for substantially a full length of said first sheet to heat fuse said first sheet to said center sheet at said first sheet peripheral edge, to heat fuse said second sheet to said center sheet at said second sheet peripheral edge, to heat fuse said first sheet to said center sheet at said plurality of first uncoated spots thereby forming a first set of tufts, and to heat fuse said second sheet to said center sheet at said plurality of second uncoated spots sheet thereby forming a second set of tufts, said first sheet and said center sheet defining a first chamber, said second sheet and said center sheet defining a second chamber, said first chamber isolated from said second chamber by said center sheet, wherein said first, second, and third sheets are heat fused together in a single step.

2. The method of claim 1 further including steps of installing a first port connected to said first chamber and installing a second port connected to said second chamber.

3. The method of claim 2 further including a step of attaching an air supply to said first and second ports, said air supply configured to supply pressurized air first to said first chamber and then to said second chamber whereby said first and second chambers are sequentially pressurized by said air supply, said air supply configured to exhaust said pressurized air first from said second chamber and then from said first chamber whereby each of said first and second chambers are sequentially exhausted while the other one of said first and second chambers are sequentially pressurized.

4. The method of claim 1 wherein each of said first pattern of said plurality of first uncoated spots on said first sheet and said second pattern of said plurality of second uncoated spots on said second sheet is a cross-hatched pattern.

5. The method of claim 1 wherein said step of applying heat includes rotating a heated roller in contact with said first sheet, said heated roller pressing against said first sheet as said heated roller moves relative to said full length of said first sheet.

6. The method of claim 1 wherein said step of applying heat uses a device configured to evenly distribute heat, said device not defining a plurality of heat fused connections.

* * * * *